United States Patent [19]

Dalebout et al.

[11] Patent Number: 5,000,442

[45] Date of Patent: Mar. 19, 1991

[54] CROSS COUNTRY SKI EXERCISER

[75] Inventors: William T. Dalebout; Richard B. Ellis, both of Logan, Utah

[73] Assignee: Proform Fitness Products, Inc., Logan, Utah

[21] Appl. No.: 481,169

[22] Filed: Feb. 20, 1990

[51] Int. Cl.[5] ..... A63B 23/35

[52] U.S. Cl. ..... 272/70; 272/97; 272/131

[58] Field of Search ..... 272/69, 70, 72, 97, 272/131, 132, 133, 134, DIG. 4

[56] References Cited

U.S. PATENT DOCUMENTS

| | | | |
|---|---|---|---|
| 3,589,720 | 6/1971 | Agamian | 272/131 |
| 4,512,571 | 4/1985 | Hermelin | 272/70 X |
| 4,540,172 | 9/1985 | Evans | 272/133 |
| 4,659,077 | 4/1987 | Stropkay | 272/97 |
| 4,743,015 | 5/1988 | Marshall | 272/97 |
| 4,804,178 | 2/1989 | Friedebach | 272/97 |
| 4,813,667 | 3/1989 | Patterson | 272/97 |
| 4,826,152 | 5/1989 | Lo | 272/97 |
| 4,867,443 | 9/1989 | Jensen | 272/70 X |
| 4,940,233 | 7/1990 | Bull et al. | 272/70 X |

FOREIGN PATENT DOCUMENTS

| | | | |
|---|---|---|---|
| 2131308 | 6/1984 | United Kingdom | 272/131 |

OTHER PUBLICATIONS

CSA Alpine Tracker Owner's Manual Assembly Instructions Style E323C (1990).

Advertisement by CML Company for NORDIC-TRACK (1990).

*Primary Examiner*—Robert Bahr

*Attorney, Agent, or Firm*—Trask, Britt & Rossa

[57] ABSTRACT

A cross country skiing exercise machine has an upright member and an extension member which are structured to move between a first upright configuration and a second configuration in which they are collapsed. The main member is positioned substantially between the parallel tracks of the cross country ski exercise machine. The feet underneath the exercise machine constitute posts about which a reciprocating strap is trained. A rotatably pair of posts are positioned about the strap to tension the strap to cause increased friction and in turn increased resistance to movement of a first trolley and a second trolley which are positioned on the tracks for operation by the user in the performance of cross country type exercises.

29 Claims, 6 Drawing Sheets

CROSS COUNTRY SKI EXERCISER

BACKGROUND OF THE INVENTION

1. Field

This application relates to exercise machines and more particularly to the type of exercise machines which are used to perform cross country skiing type exercises.

2. State of the Art

Cross country skiing exercise machines typically involve two spaced-apart tracks with two ski pedals positioned thereon. The pedals are typically, but not necessarily secured to each other to reciprocate relative to each other. That is, as one pedal moves forward on its track, the pedal on the adjacent track moves rearwardly. Some cross country ski exercise machines also include levers which are operable by the user in a to-and-fro or forward and rearward direction to simulate the use of ski poles in association with actual cross country skiing. The levers are typically positioned for operation by each hand of the user standing on the ski pedals. In some configurations, cross country skiing machines include cables interconnected between the ski pedal and the corresponding lever to provide for coordinated movement between the pedal and the lever.

Cross country ski exercise machines are also known to have an upright member extending from the forward end of the machine rearwardly to a height proximate an adult user's abdomen with an extension member extending away therefrom about which interconnecting cables between the respective pedals and lever arms are trained. Such machines are difficult to store because the upright main member and the extension member of existing or known machines interferes with easy storage or compact storage absent substantial disassembly. Further, such machines may require substantial assembly when purchased.

In addition, some cross country ski exercise machines have structure to resist movement of the ski pedals in a back and forth motion. For example, U.S. Pat. No. 4,813,667 (Watterson) illustrates a machine with cross country capability in which variable resistance may be imposed to resist the movement of the respective pedals operated by the upright user. A simplified and effective resistance system is desirable for a cross country ski machine which is substantially preassembled and easily placed in a storage condition which is compact and easily restored to an operating configuration from the storage condition.

SUMMARY OF THE INVENTION

An exercise machine has a first and second track each having forward and rearward end. The first track is spaced from the second track a preselected distance and in substantial alignment. The first trolley is positioned on the first track and the second trolley is positioned on the second track both to move forwardly and rearwardly therealong and to support one foot of an upright user.

A main member has an upper end and a lower end. The lower end is pivotally secured to and between the first and second tracks. The main member is movable between the down position in which it is located proximate the first and second track and an up position in which it extends upwardly from the first and second tracks.

An extension member has an inward and outward end. The inward end is pivotally secured to the upper end of the main member. The extension member is movable between an open position in which the extension member extends away from the main member and a closed positioned in which the extension member is positioned proximate the main member. First and second lever means are each pivotally and mechanically associated with the first and second tracks respectively for grasping and movement forwardly and rearwardly by the hands of an upright user. Reciprocating means interconnect the first and second trolleys to cause each to move relative to the other on their respective first and second tracks.

First cable means interconnects the first lever means and the first trolley to cause the first trolley to move forwardly on the first track upon rearward movement of the first lever. Similarly, second cable means interconnects the second lever means with the second trolley to cause the second trolley to move forwardly on the second track upon rearward movement of the second lever.

Preferably, the main member has a width which is sized less than the preselected distance between the first and second track. In a down position the main member is therefore positioned substantially between the first and second tracks. More preferably, the extension member is in substantial alignment with the main member when the extension member is in the closed position.

In another embodiment, the extension member has extension guide means secured at its outward end for guiding the first cable means and the second cable means thereabout. More preferably, the extension member is sized in length to extend forwardly of the first and second trolley means when the first and second trolley means are positioned proximate each other, the main member is positioned in a down position and the extension member is in a closed position.

In an alternate embodiment, the exercise machine includes resistance means to resist movement of the first trolley and the second trolley. Desirably, the reciprocating means includes strap means formed into a continuous loop to which the first and second trolleys are connected. The resistance means preferably includes a friction means to resist movement of the strap means. In a preferred arrangement, the friction means includes a first post spaced apart from a second post each mounted to a base. The strap means is trained between the first and second posts. The base is rotatable to urge the first post and the second post toward the strap means trained thereinbetween. In a highly preferred arrangement, adjustment means is provided to rotate the base. The adjustment means includes operation means positioned for operation by an upright user positioned on the first and second trolleys. Connection means interconnect between the operation means and the base to cause the base to rotate upon operation of the operation means to increase or decrease friction imposed on the strap and in turn vary the resistance of the resistance means.

In an alternate embodiment, a first trunnion is secured to the first track at its forward end; and a second trunnion is secured to the second track at its forward end in substantial axial alignment with the first trunnion. A shaft is sized to snugly and rotatably extend through the first and second trunnions. The first and second lever means are each pivotally mounted to the shaft.

The first and second trunnions are preferably spaced apart. The main member desirably has a journal at its lower end which is positioned between the first and second trunnions. The journal is sized to rotatably receive the shaft therethrough. In a highly preferred arrangement, the journal is spaced from the first trunnion and the second trunnion to form the first guide surface and the second guide surface on said shaft. The first cable means and the second cable means are each trained about their respective first guide surface and second guide surface.

The shaft has a first end and a second end which extend outwardly from the first trunnion and the second trunnion, respectively. The first lever is desirably journaled to pivot about the first end and the second lever is journaled to pivot about the second end.

In yet another embodiment, forward support guide means are secured proximate the forward end of the first track, and rear guide means are secured proximate the rearward end of said second track. The forward support guide and rear guide means guide the strap means which is trained thereabout. In a preferred construction, support means interconnect the first track with the second track. Desirably, the support means include a forward support means and a rear support means.

In a desired arrangement, the forward guide means is a pair of spaced apart forward posts positioned transverse to each other and secured to extend downwardly from the forward support means. The rear guide means is a pair of spaced apart rear posts positioned transverse to each other to extend downwardly from the rear support means. The pair of forward posts and the pair of rear posts are preferably mounted in a substantial rectilinear pattern. Support feet to support the exercise machine are preferably associated with each of the posts to support the machine on an appropriate surface.

In yet another configuration, the main member has the directional guide means secured proximate its upper end about which the first cable means and the second cable means are trained.

In yet another arrangement, the main member includes securing means to secure the main member in the up position. The extension member also includes securing means to secure the extension member in the open position.

In one embodiment, the forward support means is positioned proximate the first and second journal and has a lip extending forwardly and downwardly. The journal secured to the downward end of the main member has an extension adapted thereto. The extension is preferably secured to the lip to hold the main member in an up position by means operable by the user. Such means may be an adjustment knob with a threaded screw to interconnect the extension to the lip. The lip and the extension are desirably positioned to orient the main member upwardly and rearwardly in the up position. A cushion may be positioned at the upward end of the main member for contact with the upright user positioned on the first trolley and the second trolley.

Other embodiments of the invention will become apparent from the description of the illustrated embodiment hereinafter set forth.

BRIEF DESCRIPTION OF THE DRAWINGS

In the drawings, which illustrate what is presently regarded as the best mode for carrying out the invention.

DETAILED DESCRIPTION OF THE ILLUSTRATED EMBODIMENTS

Figure 1:
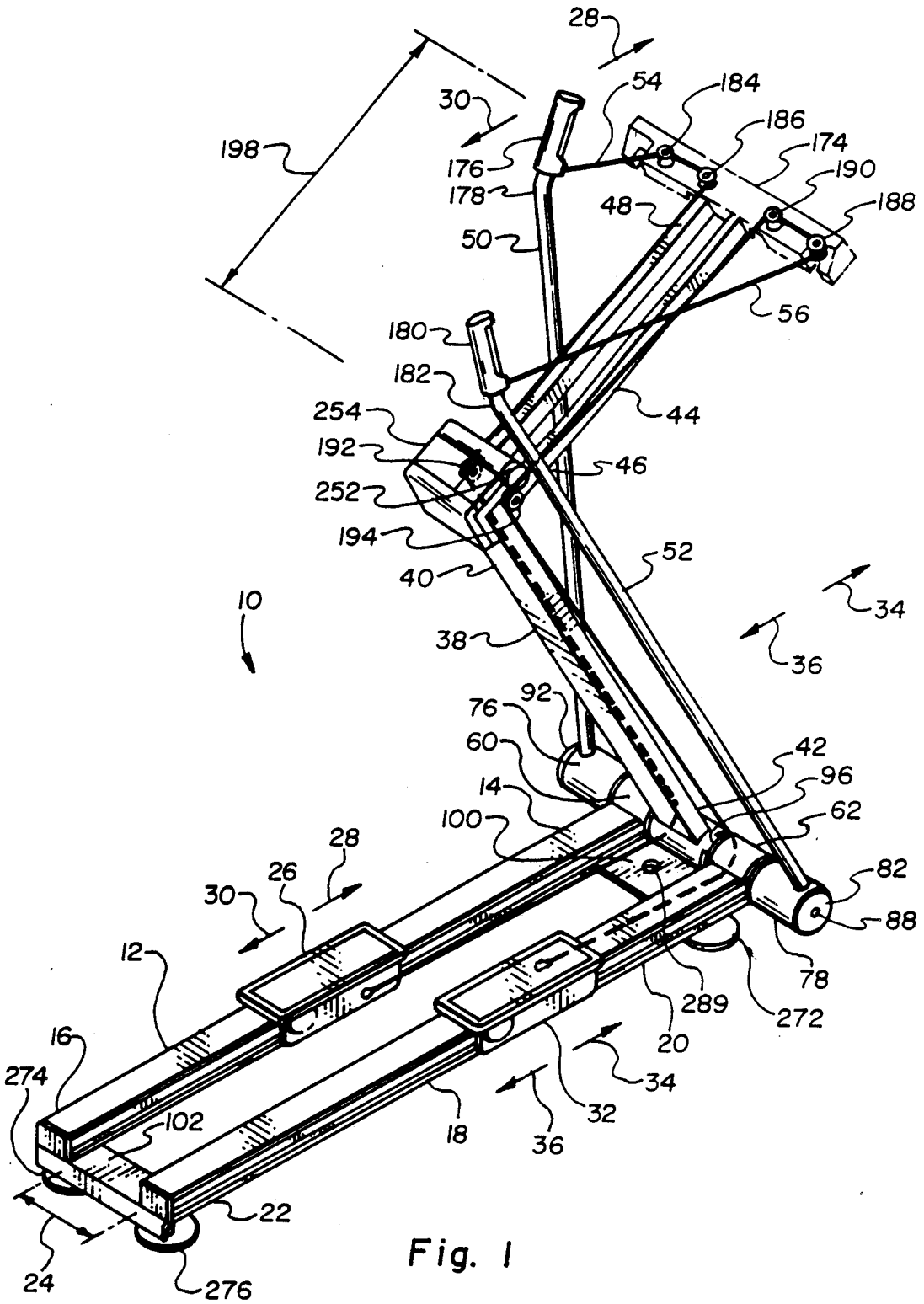
FIG. 1 is a perspective view of an exercise machine of the present invention in a first configuration.

FIG. 1 illustrates an exercise machine which is a cross country skiing type exercise machine. The depicted machine is generally referred to by the numeral 10. It has a first track 12 having a forward end 14 and rearward end 16. It also has a second track 18 with a forward end 20 and a rearward end 22. As illustrated, the second track 18 is spaced from the first track 12 a preselected distance 24. In addition, the first track 12 and the second track !8 are here shown to be in substantial alignment. Preferably they are essentially parallel.

A first trolley 26 is positioned on the first track 12 to move forwardly 28 and rearwardly 30 therealong and to support one foot of an upright user. Similarly, a second trolley 32 is positioned on the second track 18 to move forwardly 34 and rearwardly 36 and to support the other foot of an upright user.

Figure 2:
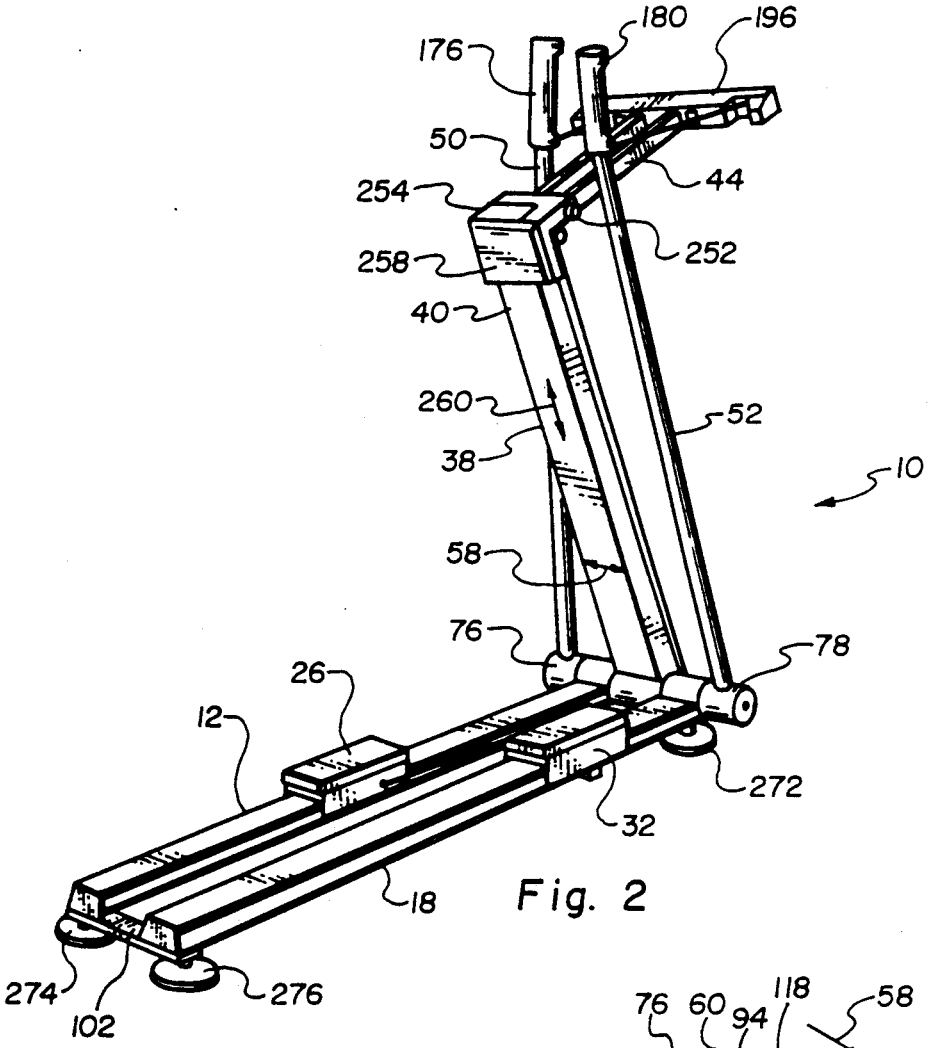
FIG. 2 is another perspective view of the invention of FIG. 1 in a first configuration.
Figure 3:
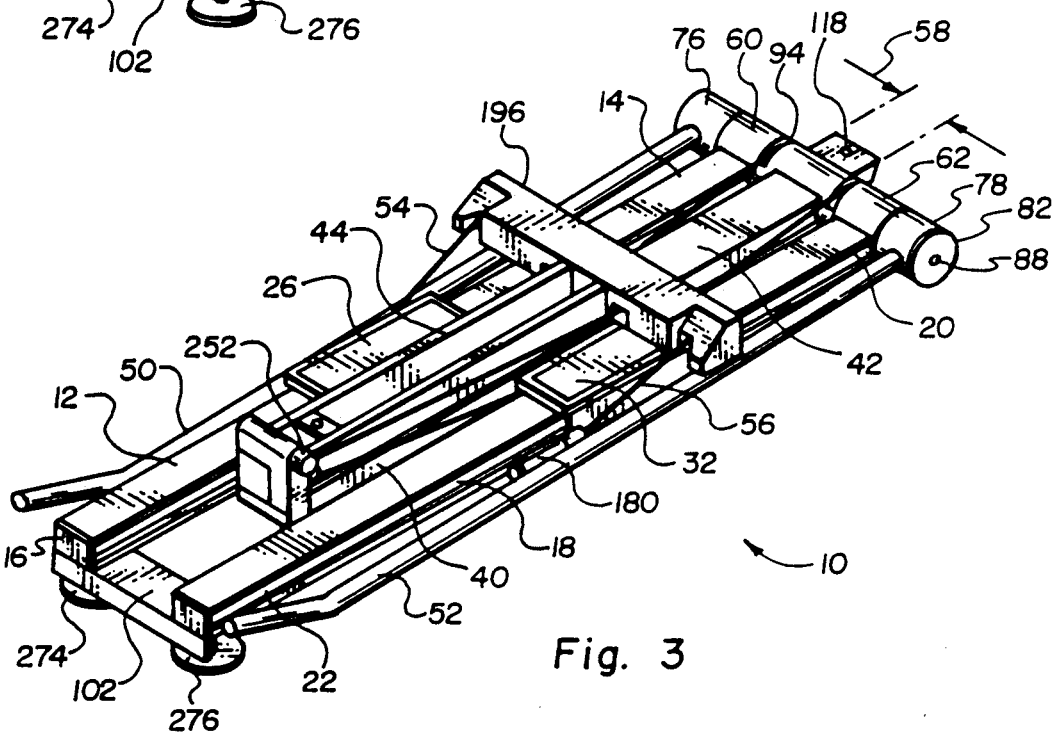
FIG. 3 is a perspective view of the invention of FIG. 1 in a second configuration.

The machine 10 has a main member 38 having an upper end 40 and a lower end 42. The lower end 42 is pivotally secured to and between the first track 12 and the second track 18 as more fully discussed hereinafter. The main member 38 is movable between a down position in which the main member is positioned proximate the first and second tracks 12 and 18 as depicted in FIG. 3, and an up position in which the main member 38 extends upwardly from the first and second tracks 12 and 18 as depicted in FIGS. 1 and 2.

The machine of FIG. 1 also has an extension member 44 which has an inward end 46 and an outward end 48. The inward end is pivotally secured to the upper end 40 of the main member 38 to move between an open position in which the extension member 44 extends away from the main member 38 and a closed position in which the extension member 44 is positioned proximate the main member 38. As seen in FIG. 1 and 2, the extension member 44 is oriented normal to the main member 38 which is the preferred open position. In FIG. 3, the main member 44 is shown in a preferred closed position.

The machine 10 of FIG. 1 also has first lever means in the form of lever 50 pivotally and mechanically associated with the first track 12 for grasping and movement forwardly 28 and rearwardly 30 by one hand of an upright user. Similarly, a second lever means in the form of 52 is pivotally and mechanically associated with the second track 18 for grasping a movement forwardly 34 and rearwardly 36 by one hand of the upright user.

The machine 10 of FIG. 1 also includes reciprocating means which is interconnected between the first trolley 26 and the second trolley 32. The reciprocating means is not shown in FIG. 1, but is discussed and illustrated in more detail hereinafter. The reciprocating means causes the first trolley 26 and the second trolley 32 to move relative to each other. That is, upon movement of the first trolley 26 forwardly 28, the second trolley 32 moves rearwardly 36. Similarly, when the second trolley 32 moves forwardly 34 the first trolley 26 moves rearwardly.

The machine 10 of FIG. 1 also includes first cable means in the form of cable 54 which interconnects the first lever 50 with the first trolley 26 to cause the trolley 26 to move forwardly 28 upon rearward 30 movement of the first lever 50. The machine 10 also includes a second cable means in the form of cable 56 interconnected between a second trolley 32 and the second lever 52. The cable 56 causes the second trolley 32 to move forwardly 34 upon rearward 36 movement of the second lever 52.

The main member 38 has a width 58 which is sized to be less than the distance 24 between the first track 12 and the second track 18. Notably, the distance 24 is selected so that the trolleys 26 and 32 are each spaced apart to be comfortable for an adult user. That is, the distance 24 is selected to be comparable to the spacing between the feet of an adult user performing cross country ski exercises. The width 58 of the main member 38 is selected to be less than distance 24 so the main member 38 can be positioned substantially between the first track 12 and second track 18 when in the down position, as illustrated in FIG. 3.

Figure 4:
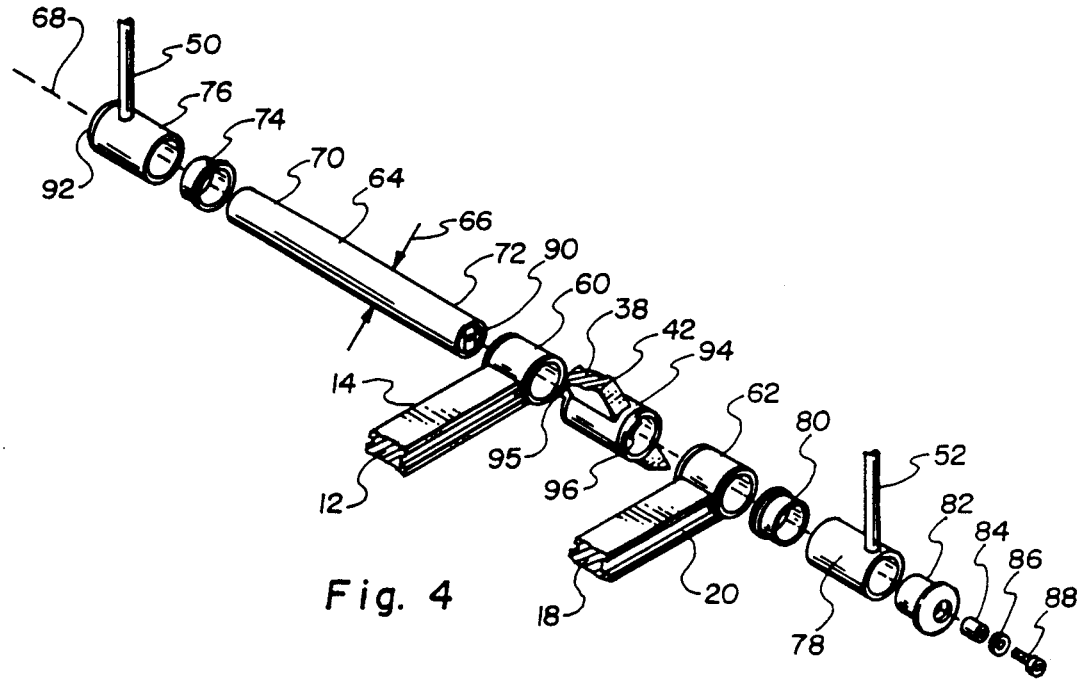
FIG. 4 is an exploded view of the forward end of the exercise machine of FIG. 1.

Referring now specifically to FIG. 4, a first trunnion 60 is secured to the forward end 14 of the first track 12. The second trunnion 62 is similarly secured to the front end 20 of the second track 18. As illustrated in FIG. 4, the trunnions 60 and 62 are hollow tube-like structures which are sized to receive shaft 64 therethrough. That is, the shaft 64 is sized in diameter 66 to slide through the trunnions 60 and 62 which are positioned to be in axial alignment 68 to receive the shaft 64.

The shaft 64 has a first end 70 and a second end 72. Upon positioning of the shaft 64 in the trunnions 60 and 62, the first end 70 extends outwardly from the first trunnions 60; and the second end 72 extends outwardly from the second trunnion 62. The first lever 50 is pivotally attached to and secured to pivot about the first end 70 of the shaft 64. It is secured in place with a bushing 74 which inter-fits with a journal 76 connected to the lever 50. Similarly, journal 78 is connected to lever 52. The journal 78 receives a bushing 80 along with an end cap 82. As illustrated in FIG. 4, the end cap 82 holds the journal 78 to the shaft 64 by use of a spacer 84, a washer 86 and a bolt 88 to interconnect to an interiorly positioned threaded connection 90 in the second end 72 of the shaft 64. A similar threaded connection is positioned inside the first end 70 of the shaft 64 to receive a bolt similar to bolt 88 (not shown) for holding an end cap 92 to the first end 70 of shaft 64.

A journal 94 is secured to the lower end 42 of the main member 38. The journal is sized to fit between the trunnions 60 and 62 and to receive the shaft 64 therethrough as illustrated. The journal 94 has a spacer tab 95 on its first end and a spacer tab 96 on its second end. The spacer tabs 95 and 96 space the journal 94 from the trunnions 60 and 62. The spacer exposes a portion of the shaft 64 which constitutes a first guide surface on the first side of the journal 94 and a second guide surface on the second side of the journal 94. The first and second cables 54 and 56 are respectively trained about the first and second guide surfaces to interconnect with the first trolley 26 and second trolley 32 respectively, as more fully illustrated in FIG. 1.

Referring to FIG. 1 a support means is provided to secure the first track 12 and the second track 18 together. A forward support 100 and a rear support 102 are shown in FIG. 1. The forward support 100 is more clearly shown in FIG. 5 to be positioned proximate the forward end of the machine 10 and more specifically proximate the forward ends 14 and 20 of the first track 12 and the second track 18 respectively. More specifically, the forward support 100 has a downwardly extending lip 104. The lip 104 extends downwardly at an angle 106 which is also the angle (about 30 degrees) at which the main member 38 extends rearwardly when in the up position.

Figure 5:
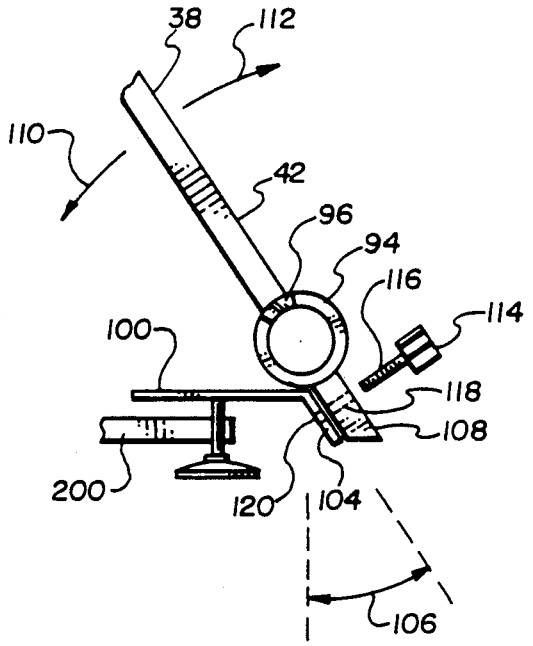
FIG. 5 is a partial simplified cross-sectional view of the forward end of the exercise machine of FIG. 1.

As best seen in FIG. 5, the journal 94 positioned at the downward end 42 of the main member 38 has an extension 108 secured thereto in general alignment with the main member 38. The main member 38 may rotate downwardly 110 to the down position as illustrated in FIG. 3 or upwardly 112 to the up position as illustrated in FIGS. 1 and 2. In the up position, the extension 108 is positioned proximate the lip 104 and is secured thereto by a knob 114 with a threaded bolt 116 sized to extend through aperture 118 and to be received in threaded aperture 120. Accordingly, the main member 38 is securely positioned at the angle 106 to extend rearwardly toward the upright user on the trolleys 26 and 32 as more fully discussed hereinafter.

Figure 6:
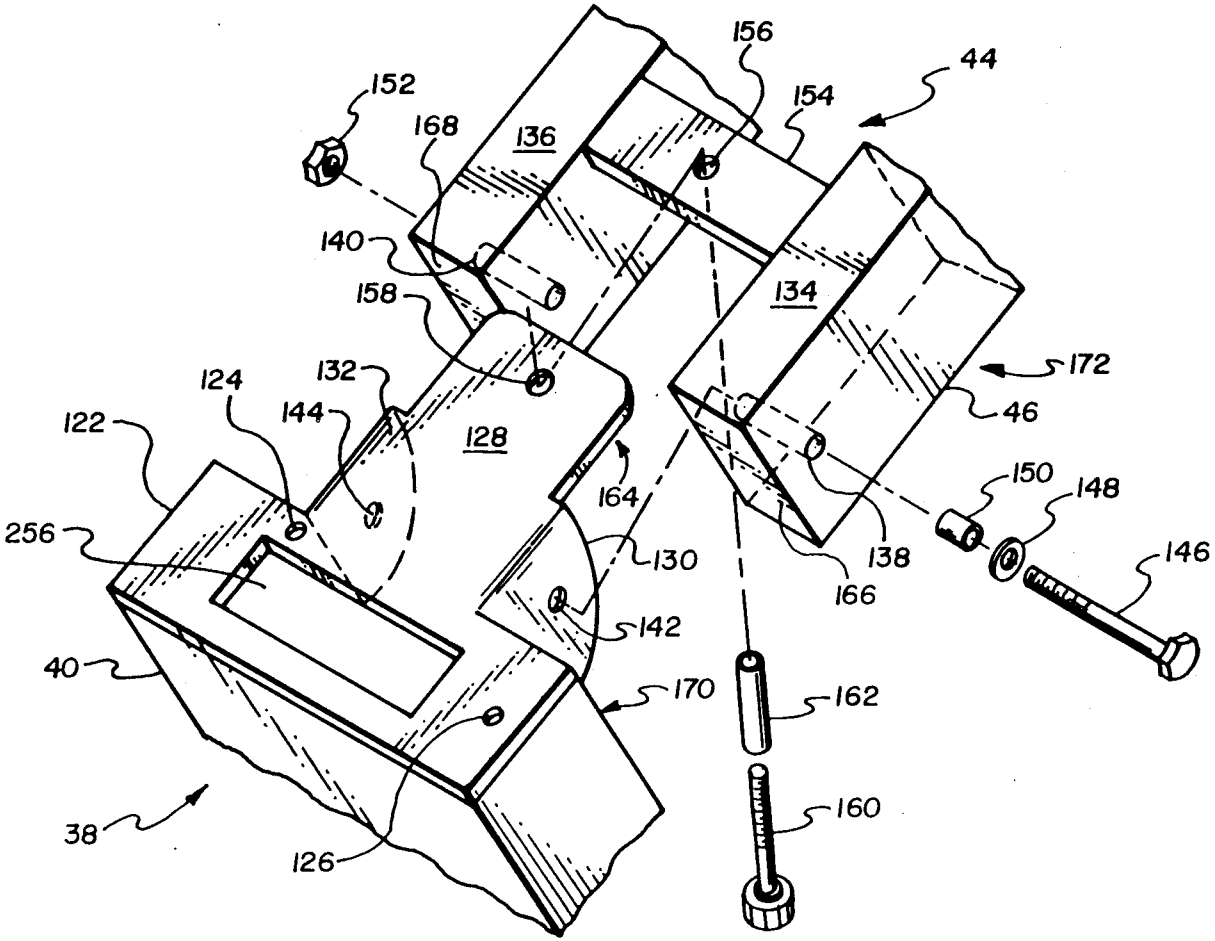
FIG. 6 is a perspective view of portions of the exercise machine of FIG. 1.

Referring now to FIG. 6, the upper end 40 of main member 38 is shown in enlarged detail with a bracket 122 secured thereto. The bracket 122 has apertures 124, and 126 formed therein to receive screws to fixedly hold the bracket 122 to the upper end 40 of the main member 38. The bracket 122 has a tongue 128 extending substantially normal thereto with a downwardly extending right flange 130 and left flange 132 shown in phantom. The inward end 46 of the extension member 44 has a right member 134 and a left member 136 which are spaced apart and sized to snugly fit about the flanges 130 and 132. The inward end 46 of the extension member 44 has apertures 138 and 140 formed therein to register with the apertures 142 and 144 formed in the flanges 130 and 132. An appropriate bolt 146 with a washer 148 and a bushing 150 may be inserted through the apertures 138, 140, 142 and 144 to interconnect with a lock nut 152 to pivotally secure the inward end 46 of the extension member 44 to the upper end 40 of the main member 38.

The extension member 44 has an inter-spacing bracket 154 secured between the spaced apart members 134 and 136. The bracket 154 has a threaded aperture 156 which is positioned to register with aperture 158 in the tongue 128 when the extension member 44 is positioned in the open position. A threaded bolt 160 with an extension bushing 162 is used to secure the spacer 154 to the underside 164 of the tongue 128 to hold the extension member 44 in the open position illustrated in FIGS. 1 and 2. Notably, the ends 66 and 168 of the right member 134 and left member 136 of the extension 44 are spaced away from the outward surface 170 of the main member 38 so that upon removal of the bolt 160, the extension member 44 may rotate to the closed position in which the under surface 172 of the extension 44 is substantially parallel to the outward surface 170 of the main member 40 as illustrated in FIG. 3.

In operation, it can be seen that the extension member 44 and the main member 38 may be secured to place the machine 10 of FIG. 1 in its first configuration as illustrated in FIGS. 1 and 2. Upon removal of the bolts 160 (FIG. 6) and 116 (FIG. 5) the machine 10 of FIG. 1 can be repositioned into a collapsed or second configuration as illustrated in FIG. 3. In effect, the extension member 44 and the upright member 38 scissor downwardly to a configuration which is compact for shipment and for storage. Further, assembly of a machine may be simplified for the user because the machine 10 may be pre-assembled by the maker so that assembly involves movement of the main member 38 to its up position and insertion of the bolt 116 and operation of the knob 114 along with operation of the extension 44 to its open position and operation of the bolt 160 to secure the extension 44 in the open position.

In FIG. 1, the extension member has an extension guide 174 secured thereto at the outer end 48. The guide 174 functions to guide the first and second cables 54 and 56 between the first lever 50 and its respective first trolley 26 and the second lever 52 and its second respective second trolley 32. As best illustrated in FIG. 2, the cable 54 is secured to a hand grip 176 positioned on the distal end 178 of the lever 50. Thus, the cable 54 can be connected to the lever 50 and disconnected from the lever 50 by simply attaching or removing the handgrip 176 from the distal end 178 of the lever 50. Similarly, the second lever 52 has a hand grip 180 secured at the distal end 182 of the lever 52. The cable 56 is secured to the handgrip 180 for attachment and removal from the lever 52.

As illustrated in FIG. 1, the cable 54 is trained about a first pulley 184 and a second pulley 186. Similarly, the second cable 56 is trained about pulleys 188 and 190. The cables 54 and 56 extend downwardly to a guide structure positioned at the upper end 40 of the main member 38. The guide structure illustrated is pulley 192 and 194. The cables 54 and 56 are thereafter led from pulleys 192 and 194 and trained about the first guide surface and second guide surface of the shaft 64. Thereafter the cables 54 and 56 are led rearwardly for connection to their respective trolleys 26 and 32. A safety cap 196 is positioned over the pulley 184, 186, 188 and 190 as best illustrated in FIG. 2.

The configuration of the cables 54 and 56 illustrated in FIG. 1 keeps the cables in alignment with the structure of the machine 10 to avoid interfering cable runs and to facilitate pre-assembly. That is, the grips 176 and 180 may be removed from the distal ends 178 and 182 respectively of the first and second levers 50 and 52, respectively. Upon removal, and positioning of the main member 38 and extension member 44 into the collapsed or stored condition as illustrated in FIG. 3, the handgrip 176 (not shown) and handgrip 180 lay proximate the tracks 12 and 18. Similarly, the handles 50 and 52 may be pivoted to be proximate to and in alignment with the tracks 12 and 18. The extension 44 is sized in length 198 to extend forwardly of the trolleys 26 and 32 when the trolleys are positioned proximate each other as illustrated in FIG. 3 and with the main member 38 in the down position as illustrated in FIG. 3.

As noted hereinbefore, the repositioning of the machine 10 of FIG. 1 between the stored or pre-assembled configuration of FIG. 3 to the assembled and upright configuration of FIG. 1 may be effected by raising the main member 38 and positioning the extension member 44 while securing both of them in their positions as hereinbefore discussed. In addition, the ribs 176 and 180 are easily positioned on the distal ends 178 and 182 of the levers 50 and 52. Thereupon, a fully assembled machine 10 is readily available for operation by the user.

Figure 7:
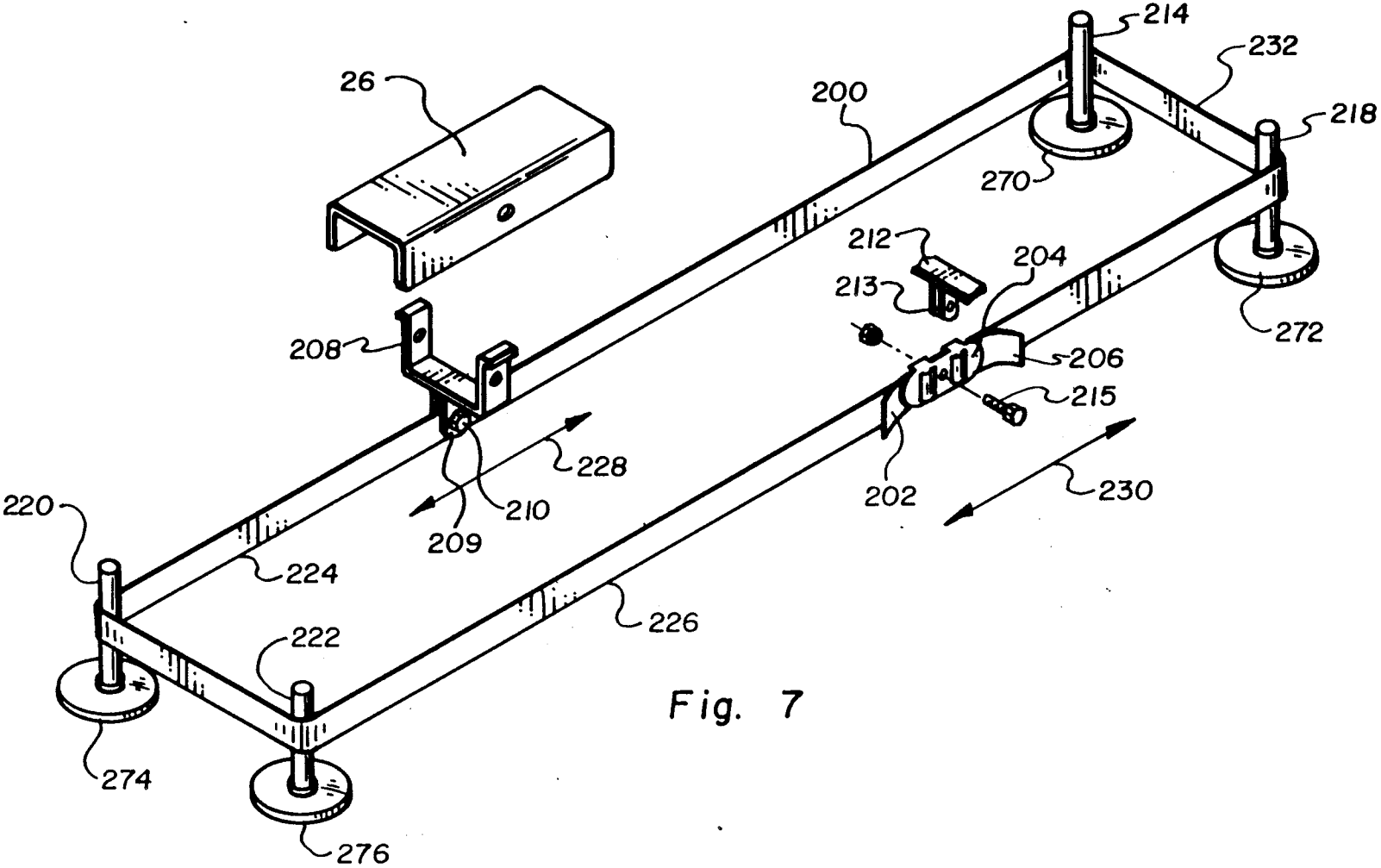
FIG. 7 is a simplified depiction of the reciprocating structure of the exercise machine of FIG. 1.

Referring now to FIG. 7, reciprocating means are provided to cause the first trolley 26 and the second trolley 32 to move relative to each other or to reciprocate on their respective tracks 12 and 18. The reciprocating means of the machine in FIG. 1 includes a strap 200 formed into a continuous loop as illustrated. More specifically, a loop is formed by taking the first end 202 and assembling it in a buckle-like fashion through a buckle structure 204. Similarly, the other end 206 may be assembled to the buckle 204.

The first trolley 26 may be connected to a drive bracket 208 with an extension 209 which is in turn connected by a bolt 210 to the strap 200. Similarly, the second trolley 32 (not shown) is connected by a bracket 212 with an extension to the strap 200 and more particularly to the buckle 204 by belt 215.

Guides are positioned under the tracks 12 and 18 to guide the strap 200. A forward guide structure and a rear guide structure are provided. As illustrated, the forward guide structure includes a first guide post 214 spaced apart from a second guide post 218. The first forward guide post 214 is preferably secured to the support 100 proximate the forward end 14 of the first track 12. Similarly, a second forward guide post 218 is secured to the support 100 proximate the forward end 20 of the second track 18.

The rear guide structure as here illustrated includes a pair of rear posts. The first rear post 220 is connected to the support 102 proximate the rearward end 16 of the first track 12 Similarly, the second rear post 222 is secured to the support 102 proximate the rearward end 22 of the second track 18. As illustrated in FIG. 7, the posts 214, 218, 220, and 222 are configured in a rectilinear pattern so that the strap 200 is positioned in a rectilinear pattern with a first stretch 224 positioned under the first track 12 and a second stretch 226 positioned underneath the second track 18. As seen in FIG. 7, forward or rearward movement 228 of the strap 200 and more particularly the first stretch 224 causes corresponding rearward and forward movement to 230 of the second stretch 226. The strap 200 is preferably made out of a low friction nylon mesh or other material which slides easily about the posts 214, 218, 220 and 222 Which are all relatively smooth and cylindrically shaped.

Figure 8:
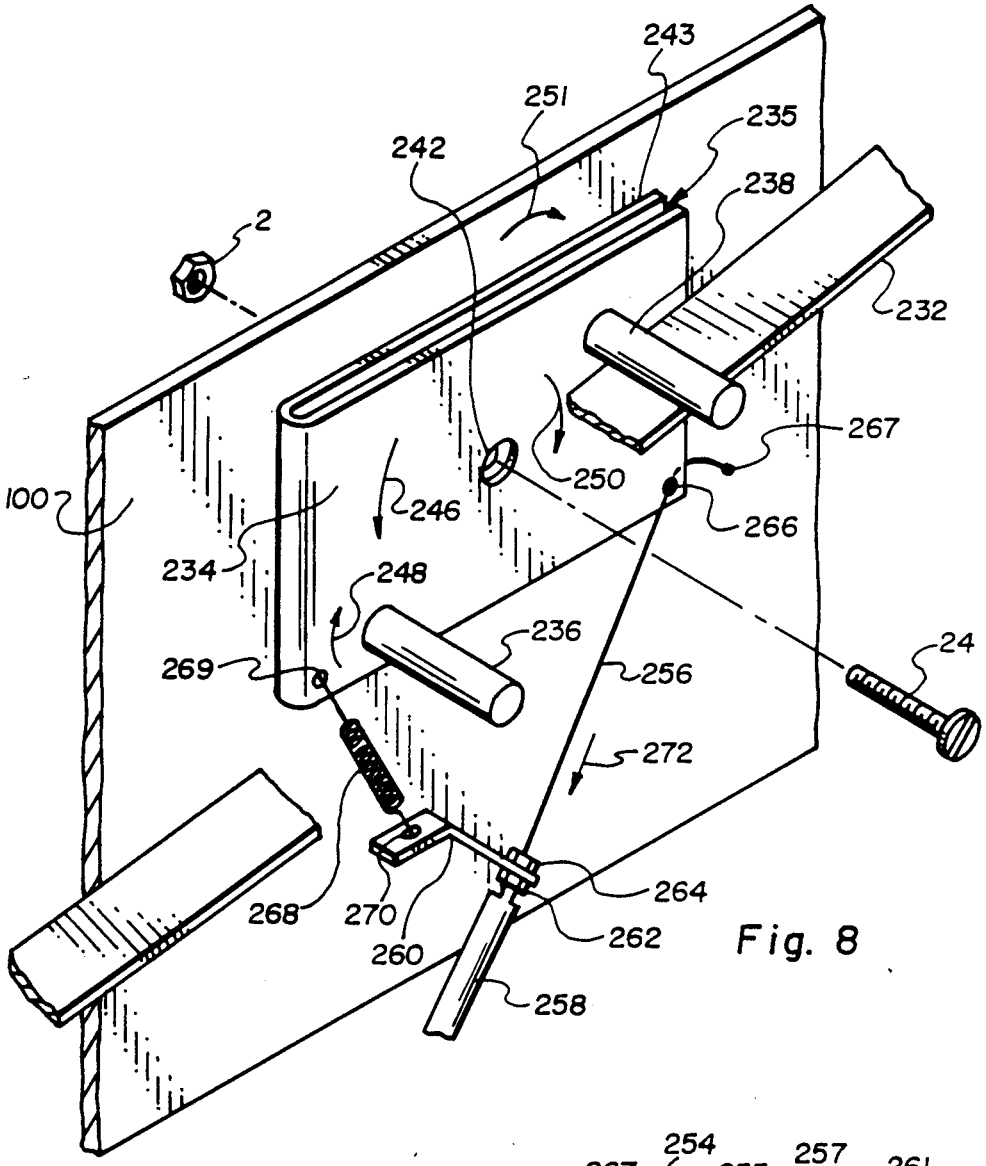
FIG. 8 is a perspective simplified view of the friction structure of the exercise machine of FIG. 1.

The strap 200 of FIG. 7 has a forward stretch 232 which is associated with resistance means and more particularly a friction means. In FIG. 8, a base 234 has a first post 236 extending away therefrom and secured thereto. It also has a second post 238 secured thereto and extending away therefrom. The post 236 and post 238 are spaced apart with the stretch 232 passing therebetween. The base 234 is secured to the support 100 by a nut 239 and a bolt 240 which passes through aperture 242 in the base 234 and corresponding apertures (not shown) in the support 100 and back base 243. The base 234 may therefore rotate 246 about the bolt 240. Upon rotation of the base 234, the pin 236 is urged upwardly 248 to press against the strap 200 and more particularly the stretch 232. At the same time, the post 238 rotates downwardly 250 to press against the stretch 232. It can be seen that increasing clockwise 251 rotation of the base 234 also increases the tension of the stretch 232 and in turn the resistance between the strap 200 and posts 214, 218, 220 and 222 (FIG. 7) as well as posts 236 and 238. The increased friction constitutes an increase in the resistance experienced by the user in moving the trolleys 26 and 32. Counter clockwise rotation 246 lessens the friction and in turn the resistance.

The base 234 is unitarily formed with a back base 243 to be "U" shaped in projection as shown in FIG. 8. The back base 243 is spaced from the base 234 to form a gap 235 so that the connection of the cable 256 at aperture 266 may be easily effected by use of a connector such as the pressed-on ball 267. The back base 243 eliminates the need for bushings, washers or other structure to space the base 234 from the support 100 to provide the needed clearance for a connector such as ball 267 as well as the connection for the spring 268 at aperture 269. The back base 243 essentially eliminates potential mechanical interference between the connector such as ball 267 and the connection of the spring 268 with the support 100.

Figure 9:
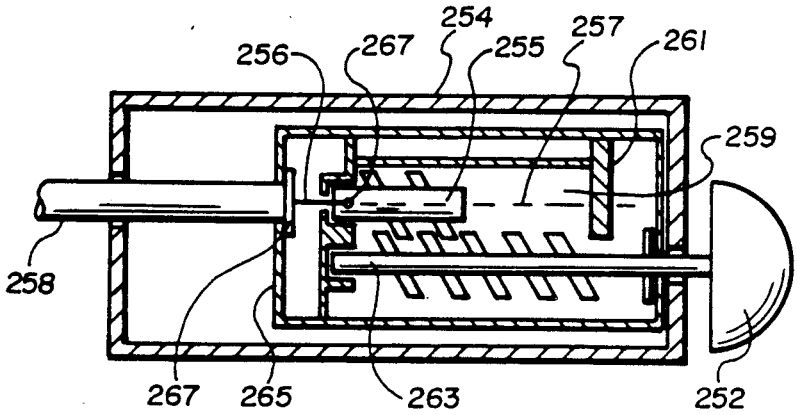
FIG. 9 is a cross-sectional view of portions of the resistance structure of the exercise machine of FIG. 1.

The base 234 may be rotated by operation means. In FIG. 9 the operation means is illustrated to include a knob 252 which is rotated in a housing 254. A cable 256 is connected to the worm 255 which moves axially 257 in the void or space 259 formed by wall members 261. The worm 255 is driven by worm shaft 263 which is connected to the knob 252. The cable 256 is in sheath 258 which passes through the housing 254. The sheath 258 is secured to an internal case 265 by lock nut 265. The cable 256 is then secured to the worm 255 by leading the cable 256 through an aperture 267.

The sheath 258 is led downwardly through the main member 38 which is hollow to a bracket 260 (FIG. 8). The sheath 258 is held to the bracket 260 by nuts 262 and 264. A cable 256 extends therefrom and is connected to an aperture 266 in the base 234. A spring 268 is interconnected between another aperture 269 in the base 234 and aperture 270 in the bracket 260. As can be seen movement of the cable 256 toward the bracket 260 as indicated by the arrow 272 tensions spring 268. Upon release of the cable 256, the spring urges the base 234 to rotate counter clockwise 246. Thus, the tension on the stretch 232 and the strap 200 can be adjusted by simply rotating the knob 252.

As shown in FIGS. 1, 2 and 3, the knob 252 is part of a display console 254 positioned at the upper end 40 of the main member 38. The sheath 258 passes from the counsel 192 through an aperture 256 formed in the bracket 122 positioned at the upper end 40 of the main member 38 (FIG. 6).

A resilient pad 258 may be secured to the upper end 40 of the main member 38 so the user may contact the upper end 40 and even position himself thereagainst during the performance of exercises in an upright position on the trolleys 26 and 32. The upright member is sized in length to 60 so that an adult user positioned on the trolleys 26 and 32 may contact the cushion 258 in the vicinity of the user's abdomen.

Referring back to FIG. 7 it can be seen that each of the posts 214, 218, 220 and 222 has a foot 270, 272, 274, and 276 secured thereto. The feet provide for support of the machine 10 on a support surface.

Reference herein to details of the illustrated embodiments is not intended to restrict the scope of the appended claims, which themselves recite those features which are regarded as essential to the invention.

What is claimed is:

1. An exercise machine comprising:

a first track having a forward end and rearward end;

a first trolley positioned on said first track to move forwardly and rearwardly therealong and to support one foot of an upright user;

a second track having a forward end and rearward end, said second track being spaced a preselected distance from and in substantial alignment with said first track;

a second trolley positioned on said second track to move forwardly and rearwardly therealong and to support the other foot of an upright user;

a main member having an upper end and a lower end, said lower end being pivotally secured to and between said first track and said second track and moveable between a down position in which said main member is positioned proximate said first track and said second track and an up position in which said main member extends upwardly from said first track and said second track;

an extension member having an inward end and an outward end, said inward end being pivotally secured to said upper end and moveable between an open position in which said extension member extends away from said main member and a closed position in which said extension member is positioned proximate said main member;

first lever means pivotally and mechanically associated with said first track for grasping and movement forwardly and rearwardly by one hand of said upright user;

second lever means pivotally and mechanically associated with said second track for grasping and movement forwardly and rearwardly by the other hand of said upright user;

reciprocating means interconnecting said first trolley and said second trolley to cause each to move relative to the other;

first cable means interconnecting said first lever means and said first trolley to cause said first trolley to move forwardly on said first track upon reward movement of said first lever means;

second cable means interconnecting said second lever means and said second trolley to cause said second trolley to move forwardly on said track upon rearward movement of said second lever means.

2. The exercise machine of claim 1 wherein said main member has a width and is sized in width less than said preselected distance, and wherein said main member is positioned between said first and said second track in said down position.

3. The exercise machine of claim 2 wherein said extension member is in alignment with said main member in said closed position.

4. The exercise machine of claim 3 further including extension guide means secured to the outward end of said extension member for guiding said first cable means and said second cable means between said first and second lever means and said first and second trolleys respectively.

5. The exercise machine of claim 4 wherein said extension member is sized in length to extend forwardly of said first trolley and said second trolley with said first trolley and said second trolley positioned proximate each other, said main member positioned in said down position and said extension member positioned in said closed position.

6. The exercise machine of claim 1 further including resistance means to resist movement of said first trolley and said second trolley.

7. The exercise machine of claim 6 wherein said reciprocating means includes strap means formed into a continuous loop to which said first and second trolleys are connected, and wherein said resistance means includes friction means to resist movement of said strap means.

8. The exercise machine of claim 7 wherein said friction means includes a first post spaced apart from a second post each mounted to a base with said strap means trained between said first and said second posts, said base being rotatable to urge said first post and said second post toward said strap means.

9. The exercise machine of claim 8 further including adjustment means having operation means positioned for operation by an upright user positioned on said first trolley and said second trolley, connection means interconnected between said operation means and said base to rotate said base upon operation of said operation means.

10. The exercise machine of claim 7 further including forward support guide means secured proximate the forward end of said first track and rear guide means secured proximate the rearward end of said second track means to guide said strap means, said strap means being trained about said forward and rear guide means.

11. The exercise machine of claim 10 further including support means in connecting said first track to said second track.

12. The exercise machine of claim 10 further including forward support means and rear support means both interconnecting said first and said second track.

13. The exercise machine of claim 12 wherein said forward guide means is a pair of spaced apart forward posts positioned transverse to each other and secured to extend downwardly from said forward support means, and wherein said rear guide means is a pair of spaced apart rear posts positioned transverse to each other and secured to extend downwardly from said rear support means.

14. The exercise machine of claim 13 wherein said pair of forward posts and rear posts are mounted in a substantially rectilinear pattern.

15. The exercise machine of claim 13 wherein support feet are associated with each of said posts to support said first track and said second track on a support surface.

16. The exercise machine of claim 1 further including a first trunnion secured to said first track at its forward end and a second trunnion secured to said second track at its forward end in substantial axial alignment with said first trunnion, a shaft sized to snugly and rotatably extend through said first and second trunnions, and wherein said first lever means and said second lever means are each pivotally mounted to said shaft.

17. The exercise machine of claim 16 wherein said first and second trunnions are spaced apart and wherein said main member has a journal at its lower end which is positioned between said first and second trunnions, said journal being sized to rotatably receive said shaft therethrough.

18. The exercise machine of claim 17 wherein said journal is spaced from said first trunnion and said second trunnion to form a first guide surface and second guide surface, and wherein said first cable means is trained about said first guide surface and said second cable means is trained about said second guide surface.

19. The exercise machine of claim 18 wherein said shaft has a first and a second end which extend outwardly from said first trunnion and said second trunnion respectively and wherein said first leer is journaled to pivot about said first end and said second lever is journaled to pivot about said second end.

20. The exercise machine of claim 18 wherein said main member has directional guide means secured proximate its upper end about which is trained said first cable means and said second cable means.

21. The exercise machine of claim 17 further including a support interconnecting said first track and said second track proximate said first and second journals with a lip extending forwardly and downwardly from said first trunnion and said second trunnion.

22. The exercise machine of claim 21 wherein said journal has an extension adapted thereto, and wherein said extension is secured to said lip in said up position by means operable by a user.

23. The exercise machine of claim 22 wherein said lip and said extension are oriented to orient the main member upwardly and rearwardly in said up position.

24. The exercise machine of claim 1 wherein said main member includes main securing means to secure said main member in said position, and wherein said extension member includes extension securing means to secure said extension member in said open position.

25. The exercise machine of claim 1 wherein said main member angulates upwardly and rearwardly at an angle of about 30 degrees from the vertical in said up position.

26. The exercise machine of claim 25 wherein said upper end of said main member has cushion means for contact with an upright user positioned on said first trolley and said second trolley.

27. A cross country skiing exercise machine comprising:

a first track having a forward end and a rearward end with a first trunnion secured at it forward end;

a first trolley positioned on said first track to move forwardly and rearwardly therealong and to support one foot of an upright user;

a second track having a forward end and a rearward end, said second track being spaced a preselected distance from and in alignment with said first track and with a second trunnion secured at its forward end in axial alignment with and spaced from said first trunnion;

a second trolley positioned on said second track to move forwardly and rearwardly therealong and to support the other foot of an upright user;

a support positioned under said first track and said second track and secured thereto;

a shaft having a first and a second end and sized to extend through said first trunnion and said second trunnion;

a main member having an upper end and a lower end, said lower end having a journal affixed thereto positioned between said first trunnion and said second trunnion to rotatably receive said shaft therethrough, said main member being sized in width less than said preselected distance and being rotatable between an up position in which said main member extends upwardly and rearwardly from said first trunnion and a down position in which said main member is positioned substantially in alignment with and between said first track and said second track, said main member having securing means at its lower end to secure said main member in said up position;

an extension member having an inward end and an outward end, said inward end being pivotally mounted proximate said upper end of said main member and movable between an open position in which said extension member extends away from said main member and a closed position in which said extension member is positioned in alignment with and proximate said main member;

first lever means pivotally secured to said first end of said shaft and sized for grasping and movement forwardly and rearwardly by one hand of said upright user;

second lever means pivotally secured to said second end of said shaft and sized for grasping and movement forwardly and rearwardly by the other hand of said upright user;

reciprocating means interconnecting said first trolley and said second trolley to cause each to move relative to the other;

first cable means interconnecting said first lever means and said first trolley to cause said first trolley to move forwardly on said first track upon rearward movement of said first lever means;

second cable means interconnecting said second lever means and said second trolley to cause said second trolley to move forwardly on said track upon rearward movement of said first lever means;

a first guide surface on said shaft between said first trunnion and said journal to guide said first cable means thereabout;

a second guide surface on said shaft between said second trunnion and said journal to guide said second cable means thereabout;

guide structure at said upper end of said main member to guide said first and second cable means from said first and second guide surfaces;

guide means at the outward end of said extension member to guide said first and second cable means from said guide structure to said first lever means and said second lever means respectively.

28. A cross country skiing exercise machine comprising:

a first track having a forward and rearward end;

a first trolley positioned on said first track to move forwardly and rearwardly therealong and to support one foot of an upright user;

a second track having a forward end and rearward end, said second track being spaced a preselected distance from and in substantial alignment with said first track;

a second trolley positioned on said second track to move forwardly and rearwardly therealong and to support the other foot of an upright user;

reciprocating means interconnecting said first trolley and said second trolley to cause each to move relative to the other, said reciprocating means including:

a first forward guide positioned proximate and under the forward end of said first track, a second guide positioned proximate and under the forward end of said second track, a first rear guide positioned proximate and under the rearward end of said first track, a second rear guide positioned proximate and under the rearward end of said second track;

a strap trained about said first and second forward guides and first and second rearward guides to have a first stretch under said first track which is connected to said first trolley and a second stretch under said second track which is connected to said second trolley; and resistance means to resist movement of said first trolley and said second trolley, said resistance means including a first post spaced from a second post, said first post and said second post both being mounted to a base with said strap trained between said first and said second posts, said base being rotatable to urge said first post and said second post toward said strap.

29. A cross country skiing exercise machine of claim 28 further including operation means positioned for operation by an upright user positioned on said first trolley and said second trolley to supply resistance signals to vary the resistance of said resistance means, connection means interconnected between said operation means and said base to rotate said base upon operation of said operation means in accordance with the resistance signals.

* * * * *

UNITED STATES PATENT AND TRADEMARK OFFICE

CERTIFICATE OF CORRECTION

PATENT NO. : 5,000,442

DATED : March 19, 1991

INVENTOR(S) : William T. Dalebout, Richard B. Ellis

It is certified that error appears in the above-identified patent and that said Letters Patent is hereby corrected as shown below:

Col. 1, line 55, between "having" and before "forward" insert ---a--- .

Col. 4, line 28, delete "!8" and add ---18---.

Col. 6, line 59, after "ends" delete "66" and add ---166---.

Col. 8, line 32, after "12" and before "Similarly" insert ---.(a period)---.

Col. 9, line 44, before "192" delete "counsel" and insert ---console---.

Col. 11, line 68, before "is" delete "leer" and insert ---lever---.

Col. 12, line 21, between "said" and "position" insert ---up---.

Col. 13, line 46, before "and" insert ---end---.

Col. 14, line 17, after "second" insert ---forward---.

UNITED STATES PATENT AND TRADEMARK OFFICE

CERTIFICATE OF CORRECTION

PATENT NO. : 5,000,442

DATED : March 19, 1991

INVENTOR(S) : William T. Dalebout, Richard B. Ellis

It is certified that error appears in the above-identified patent and that said Letters Patent is hereby corrected as shown below:

Col. 10, line 37, before "movement" delete "reward" and insert ---rearward---.

Col. 12, line 35, before "forward" delete "it" and add ---its---.

Signed and Sealed this

Sixteenth Day of November, 1993

*Attest:*

*Attesting Officer*

BRUCE LEHMAN

*Commissioner of Patents and Trademarks*